US007281910B2

(12) United States Patent
Hasegawa

(10) Patent No.: US 7,281,910 B2
(45) Date of Patent: Oct. 16, 2007

(54) MOTOR DRIVEN COMPRESSOR

(75) Inventor: Takehiro Hasegawa, Isesaki (JP)

(73) Assignee: Sanden Corporation, Gunma (JP)

( * ) Notice: Subject to any disclaimer, the term of this patent is extended or adjusted under 35 U.S.C. 154(b) by 676 days.

(21) Appl. No.: 10/793,869

(22) Filed: Mar. 8, 2004

(65) Prior Publication Data

US 2004/0179959 A1 Sep. 16, 2004

(30) Foreign Application Priority Data

Mar. 11, 2003 (JP) ..... 2003-064788

(51) Int. Cl.
*F04B 17/00* (2006.01)
*F04B 17/06* (2006.01)

(52) U.S. Cl. ..... 417/410.5; 417/364; 418/60; 310/71

(58) Field of Classification Search ..... 417/364, 417/410.5, 374; 418/60, 3, 5, 58; 310/71
See application file for complete search history.

(56) References Cited

U.S. PATENT DOCUMENTS

| | | | | |
|---|---|---|---|---|
| 3,913,346 | A | 10/1975 | Moody, Jr. | 62/197 |
| RE30,499 | E | 2/1981 | Moody, Jr. | 62/117 |
| 4,347,453 | A | 8/1982 | Gaus | 310/104 |
| 4,439,118 | A | 3/1984 | Iimori | 418/55 |
| 4,475,875 | A | 10/1984 | Sugimoto | 418/55 |
| 4,597,724 | A | 7/1986 | Sato | 418/55 |
| 4,824,346 | A | 4/1989 | Hiraga | 418/55 |
| 4,846,635 | A | 7/1989 | Fry | 417/410 |
| 4,900,238 | A * | 2/1990 | Shigemi et al. | 417/410.5 |
| 4,903,497 | A | 2/1990 | Zimmern | 62/113 |
| 4,936,112 | A | 6/1990 | Miller | 62/505 |
| 4,998,864 | A | 3/1991 | Muir | 417/410 |
| 5,103,652 | A | 4/1992 | Mizuno | 62/505 |
| 5,329,788 | A | 7/1994 | Caillat | 62/505 |
| 5,350,039 | A | 9/1994 | Voss | 184/6.16 |
| 5,857,348 | A | 1/1999 | Conry | 62/209 |
| 5,993,171 | A | 11/1999 | Higashiyama | 417/310 |
| 5,993,177 | A | 11/1999 | Terauchi | 417/440 |
| 6,017,205 | A | 1/2000 | Weatherston | 418/55.6 |
| 6,086,335 | A | 7/2000 | Bass | 417/220 |
| 6,112,535 | A | 9/2000 | Hollenbeck | 62/228.4 |
| 6,132,179 | A | 10/2000 | Higashiyama | 417/310 |
| 6,202,428 | B1 | 3/2001 | Katayama | 62/160 |
| 6,225,399 | B1 | 5/2001 | Araki | 524/544 |
| 6,234,769 | B1 | 5/2001 | Sakai | 417/374 |

(Continued)

FOREIGN PATENT DOCUMENTS

JP 2000127753 A * 5/2000

*Primary Examiner*—Anthony Stashick
*Assistant Examiner*—Tresa Vidayathil
(74) *Attorney, Agent, or Firm*—Baker Botts L.L.P.

(57) ABSTRACT

A motor driven compressor having a motor for driving a compression mechanism includes a connecting portion for connecting between an external terminal for supplying electricity to the motor and a wire end portion of a stator of the motor. The connecting portion is located above the motor and the compression mechanism. Further, the connecting portion is formed on the stator housing which accommodates the motor and the stator. The connecting portion is disposed in a hollow projection portion, which extends upward from the housing. Accordingly, the motor driven compressor which is readily manufactured, may avoid a leakage current by insulating a terminal portion of the motor from the housing of compressor.

5 Claims, 2 Drawing Sheets

U.S. PATENT DOCUMENTS

| | | | | |
|---|---|---|---|---|
| 6,261,071 | B1 | 7/2001 | Williams | 417/371 |
| 6,278,910 | B1 | 8/2001 | Miura | 700/297 |
| 6,315,528 | B1 | 11/2001 | Williams | 417/410.5 |
| 6,321,563 | B1 | 11/2001 | Ikeda | 62/505 |
| 6,495,247 | B1 | 12/2002 | Takezawa | 428/220 |
| 6,540,489 | B1 | 4/2003 | Higashiyama | 417/410.1 |
| 6,564,576 | B2 | 5/2003 | Shibuya | 62/505 |
| 6,619,933 | B2 | 9/2003 | Ikeda | 417/410.1 |
| 2002/0039532 | A1 | 4/2002 | Saito | 417/310 |
| 2002/0062656 | A1 | 5/2002 | Suitou | 62/259.2 |

* cited by examiner

MOTOR DRIVEN COMPRESSOR

BACKGROUND OF THE INVENTION

1. Field of the Invention

The present invention relates to a motor driven, hybrid compressor for use in an air conditioner for vehicles, and more specifically, relates to a structure of the compressor for preventing leakage current.

2. Description of Related Art

In a motor driven compressor having a motor for driving a compression mechanism, a high-voltage motor frequently is used. Therefore, the structure between terminal portion of the motor and the motor housing or the compressor housing (e.g., the body portion of the compressor) is insulated for safety. A structure which does not leak current is desired. In such motor driven compressors, liquid refrigerant (i.e., the liquid state of refrigerant gas) and oil with high electric conductivity suspended in the liquid refrigerant are considered to be causes of leakage current. When the liquid refrigerant and the oil enter into the motor side of the compressor, there is the possibility of leakage current. In a known motor driven compressor, a terminal portion of the motor of the motor driven compressor is positioned within uppermost portion of the motor driven compressor. Nevertheless, when the liquid refrigerant is collected on the motor-side of the motor driven compressor, because the distance between the terminal portion and the liquid level may be relatively small, the terminal portion may become submerged in the liquid refrigerant, thereby causing leakage current.

A connecting portion between an external terminal for supplying electricity to the motor of the compressor and a wire end portion of a stator of the motor of the compressor may considered to leak current readily. In known motor driven compressors, no measures appear to have been taken against such leakage current. In order to maintain a high degree of insulation, a connecting portion, which is separated or isolated from the liquid refrigerant and oil, is required. Nevertheless, if the connecting portion and the liquid refrigerant are separated mechanically by a seal mechanism or the like, the internal structure of the compressor may become complicated, and assembly and manipulation of the connecting portion become remarkably difficult.

A hybrid compressor for use in an air conditioner for vehicles and capable of being driven by an engine of a vehicle (e.g., an internal combustion engine of a vehicle or an electric motor of a vehicle) or a motor (e.g., a motor contained within the housing of the compressor) is described in Japanese Utility Model No. 6-87678. A hybrid compressor also is disclosed in Japanese Patent Application Nos. JP A 2001-280630 (JP-A-2002-031664) This hybrid compressor comprises a first compression mechanism of a scroll-type, compressor which is driven exclusively by an engine of a vehicle (e.g., an internal combustion engine of a vehicle or an electric motor of a vehicle) and a second compression mechanism of a scroll-type compressor, which is driven exclusively by a motor contained within the housing of the hybrid compressor. The fixed scrolls of each of the first and second compression mechanism are disposed back-to-back, e.g., extend in opposite directions from a common or shared valve plate, and are integrally formed with each other. In such a hybrid compressor, because the first compression mechanism and the second compression mechanism are driven selectively or simultaneously, improved compressor efficiency may be obtained.

Nevertheless, the hybrid compressor contains the motor, and a liquid refrigerant may enter into the second compression mechanism (i.e., the motor driven compression mechanism). In such a hybrid compressor, high electric conductivity is required to deliver electricity to operate the motor driven compression mechanism. When the amount of liquid refrigerant is increased in the motor driven compression mechanism, leakage current may occur readily.

SUMMARY OF THE INVENTION

It is an object of the present invention to provide a motor driven hybrid compressor, which has an uncomplicated structure and may more completely avoid leakage current by providing insulation between a terminal portion of the motor and the housing of the compressor.

To achieve the foregoing and other objects, a motor driven compressor according to the present invention is provided. The motor driven compressor having a motor for driving a compression mechanism comprises a connecting portion for connecting between an external terminal for supplying electricity to the motor and a wire end portion of a stator of the motor. The connecting portion is located above the motor and the compression mechanism.

In the motor driven compressor, the connecting portion is formed in a housing which accommodates the motor and in which the stator is fixed, and the connecting portion is positioned in a hollow projection portion which extends upward. The hollow projection portion is substantially sealed from the exterior of the motor driven compressor.

In the motor driven compressor of the present invention, a motor driven compressor may contain and use a motor for driving a single compression mechanism. Further, the motor driven compressor of the present invention may be a hybrid compressor which comprises a first compression mechanism, which is driven by a first drive source different from the motor, and a second compression mechanism, which is driven by the motor as a second drive source. In the hybrid compressor, each of the first and second compression mechanisms may be a scroll-type compression mechanism, a first fixed scroll of the first compression mechanism and a second fixed scroll of the second compression mechanism are disposed back-to-back e.g., to extend in opposite directions from a common valve plate. In addition, the first fixed scroll and the second fixed scroll are formed integrally. When the hybrid compressor is mounted in a vehicle, the first drive source may comprise an engine for driving the vehicle. The engine of a vehicle for use in driving the first compression mechanism may comprise an internal combustion engine or an electric motor for driving a vehicle.

In the motor driven compressor according to the present invention, because a connecting portion for connecting between an external terminal for supplying electricity to the motor and a wire end portion of a stator of the motor is above the motor and the compression mechanism, if a liquid refrigerant containing oil collects in the second compression mechanism (e.g., the motor driven compression mechanism), the liquid level of the refrigerant does not readily contact the connecting portion; therefore, the connecting portion may maintain high insulation performance.

In particular, because the connecting portion is formed in a housing, which accommodates the motor and in which the stator is fixed, and is disposed in a hollow projection portion which is extends upward from the stator housing. When the inside of the stator housing is filled with liquid refrigerant, the connecting portion does not readily contact the liquid refrigerant; therefore, the connecting portion may maintain high insulation performance. Further, because the hollow projection portion is substantially sealed to the exterior of compressor, when the inside of the stator housing is filled with the liquid refrigerant, the liquid level is prevented from rising into the hollow projection portion by a gaseous body (i.e., refrigerant gas) trapped inside of hollow projection portion. Therefore, the connecting portion may maintain high insulation performance.

As a result, leakage current from the connecting portion to the stator housing of compressor may be reduced or avoided, and the motor driven compressor may operate stably and safely. Particularly, in hybrid compressors, as described above, because operating rate of the second compression mechanism (e.g., the motor driven compression mechanism) generally is lower than that of the first compression mechanism (e.g., the engine driven compression mechanism); thus, liquid refrigerant collects in the second compression mechanism matter than first compression mechanism. Therefore, the present invention is suitable for the hybrid compressor, and may avoid leakage current.

Other objects, features, and advantages will be apparent to persons of ordinary skill in the art in view of the following detailed description of the invention and the accompanying drawings.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
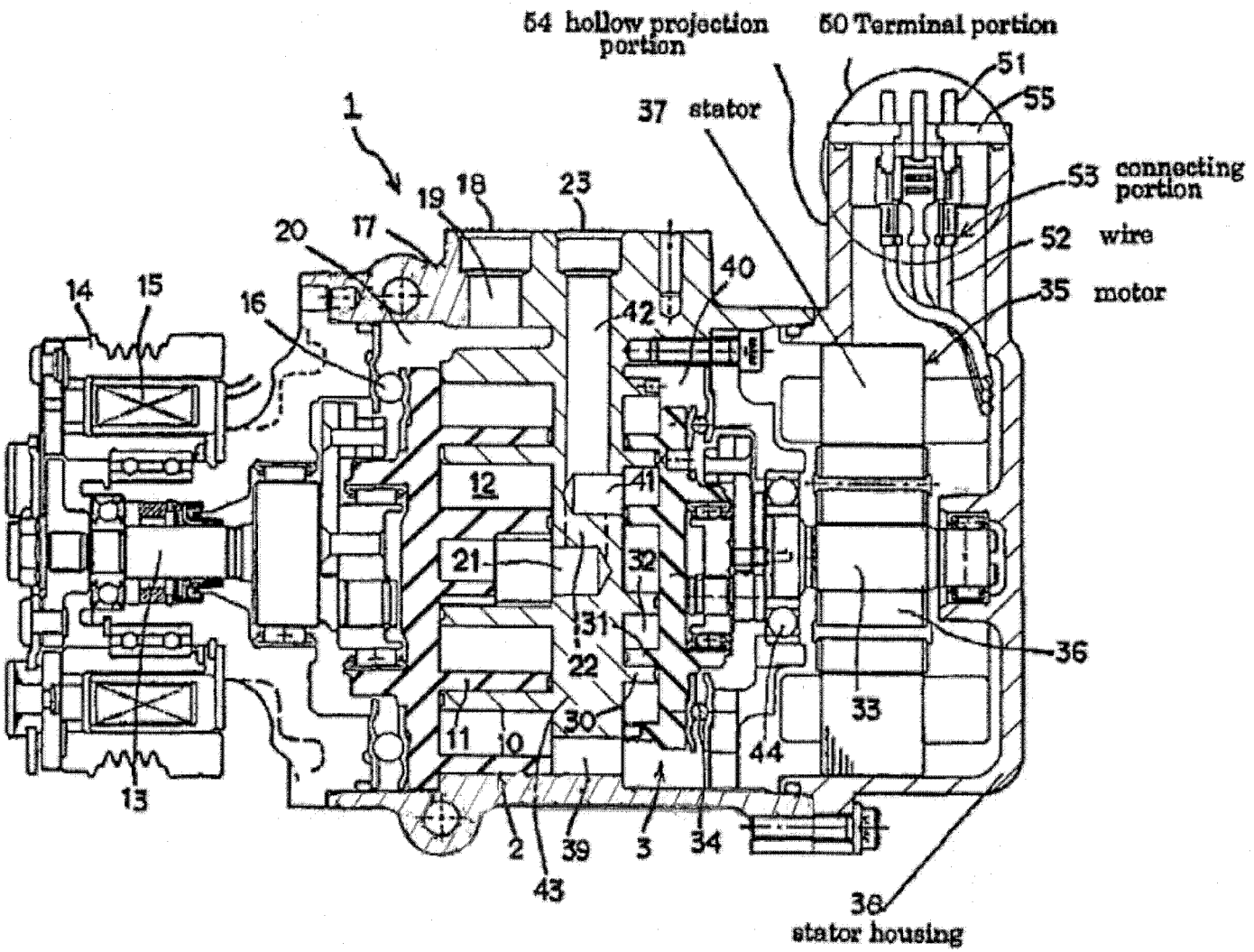
FIG. 1 is a vertical, cross-sectional view of a hybrid compressor, according to an embodiment of the present invention.
Figure 2:
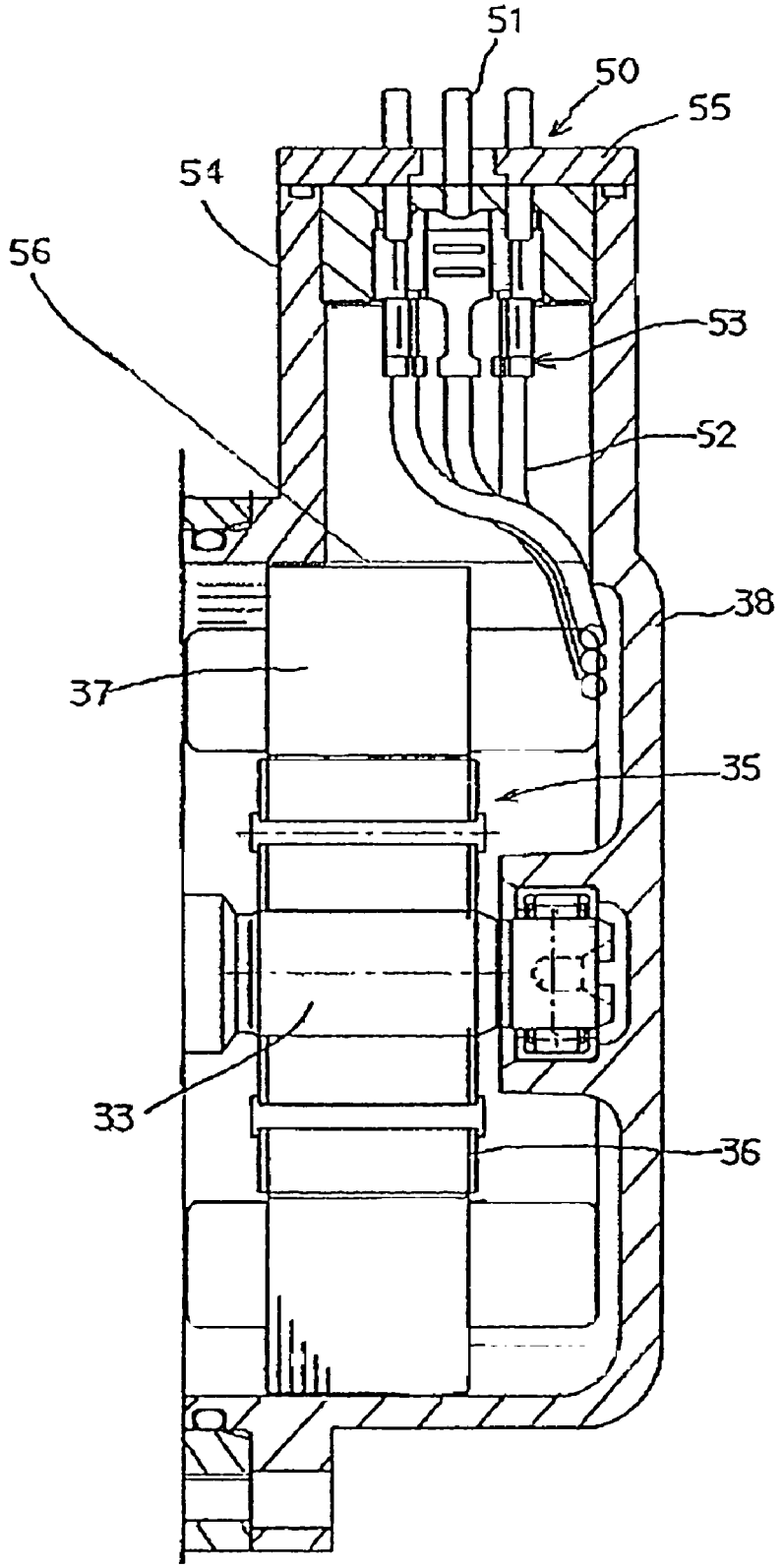
FIG. 2 is an enlarged, partial cross-sectional view of a motor and stator housing of the hybrid compressor of FIG. 1.

Referring to FIGS. 1 and 2, a preferred embodiment of the present invention is depicted. FIG. 1 depicts a hybrid compressor according to an embodiment of the present invention. FIG. 2 depicts a motor and a stator housing of the compressor of FIG. 1.

With reference to FIG. 1, a hybrid compressor 1 comprises a first compression mechanism 2 and a second compression mechanism 3. First compression mechanism 2 comprises a first fixed scroll 10; a first orbital scroll 11, which engages first fixed scroll 10 to form a first plurality of pairs of fluid pockets 12; a drive shaft 13, which engages first orbital scroll 11 and imparts an orbital movement to orbital scroll 11; an electromagnetic clutch 15 for engaging and disengaging drive shaft 13; and a pulley 14, which is connected to an engine or electric motor (not shown) of a vehicle via a belt (not shown). A first rotation prevention device 16 prevents the rotation of first orbital scroll 11. A first inlet port 18 is formed through a compressor housing 17. Refrigerant gas introduced from first inlet port 18 to first inlet chamber 20 through a first inlet path 19, flows into fluid pockets 12. Fluid pockets 12 move toward the center of first fixed scroll 10 while being reduced in volume. Consequently, the refrigerant gas in fluid pockets 12 is compressed. The compressed refrigerant gas is discharged into a first discharge path 22 through a first discharge port 21 formed within a valve plate of the fixed scroll 10. The discharged refrigerant then flows out to a high pressure side of an external refrigerant circuit through outlet port (not shown).

In contrast, second compression mechanism 3 comprises a second fixed scroll 30; a second orbital scroll 31, which engages second fixed scroll 10 to form a second plurality of pairs of fluid pockets 32; a drive shaft 33, which engages second orbital scroll 31 and imparts an orbital movement to orbital scroll 31; and a second rotation prevention device 34 for preventing the rotation of second scroll 31. An electric motor 35 is provided for driving second drive shaft 33 of second compression mechanism 3. Electric motor 35 has a rotor 36, which is fixed to second drive shaft 33, and a stator 37. Stator 37 is disposed within stator housing 38, and motor 35 also is accommodated within stator housing 38. In second compression mechanism 3, refrigerant gas is introduced from inlet port 18 to first inlet chamber 20 and flows into a second inlet chamber 40 of second compressing mechanism 3 through a communicating path 39. Refrigerant gas then is introduced to second fluid pockets 32 of second compression mechanism 3. Fluid pockets 32 move toward the center of second fixed scroll 30, while being reduced in volume. Consequently, the refrigerant gas in fluid pockets 32 is compressed. The compressed refrigerant gas is discharged into a second discharge path 42 through a second discharge port 41 formed within a valve plate of the fixed scroll 30. The discharged refrigerant then flows out to a high pressure side of an external refrigerant circuit through outlet port 23.

In a preferred embodiment of the present invention, first fixed scroll 10 of first compression mechanism 2 and second fixed scroll 30 of first compression mechanism 3 are disposed back-to-back, e.g., extend in opposite directions from a common valve plate, and the fixed scrolls are formed integrally. Thus, fixed scrolls 10 and 30 form an integral, fixed scroll member 43.

When hybrid compressor 1 is driven exclusively by an engine, electromagnetic clutch 15 is activated. The rotational output of the engine is transmitted to first drive shaft 13 of the first compression mechanism 2, and first orbital scroll 11 is driven in its orbital movement by first drive shaft 13. When driven in this matter, electricity need not be, and generally is not, supplied to electric motor 35 provided for driving second compression mechanism 3. Consequently, electric motor 35 does not rotate. Therefore, second compression mechanism 3 does not operate.

When hybrid compressor 1 is driven exclusively by an electric motor 35, electric motor 35 is activated. The rotational output of the electric motor 35 is transmitted to second drive shaft 33 of second compression mechanism 3, and second orbital scroll 31 is driven in its orbital movement by second drive shaft 33. When driven in this manner, electricity is not supplied to electromagnetic clutch 15 of first compression mechanism 2, and the rotational output of the engine of a vehicle is not transmitted to first compression mechanism 2. Therefore, first compression mechanism 2 does not operate.

When hybrid compressor 1 is driven simultaneously by an engine and electric motor 35, the rotational output of the engine is transmitted to first drive shaft 13 of first compression mechanism 2, and electric motor 35 is activated. The rotational output of electric motor 35 is transmitted to second drive shaft 33 of second compression mechanism 3.

In hybrid compressor 1, described above, refrigerant gas and oil contained in the refrigerant gas is introduced to second inlet chamber 40 of second compression mechanism 3 driven by electric motor 35 and enters into stator housing 38 (e.g., motor housing) via rotation prevention device 34 portion and bearing portion 44. Therefore, because the operating ratio of second compression mechanism 3 is lower than first compression mechanism 2, liquid refrigerant collects more readily in second compression mechanism 3 than first compression mechanism 1, and similarly, the liquid refrigerant collects in stator housing 38.

FIG. 1 and FIG. 2 depict hybrid compressor 1 mounted on a vehicle, and a terminal portion 50 of motor 35 is disposed in an upper portion of hybrid compressor 1. Terminal portion 50 has a connecting portion 53 for connecting an external terminal 51 for supplying electricity to electric motor 35 and a wire 52 of stator 37 of motor 35. Connecting portion 53 is positioned above motor 35 and second compression mechanism 3. In this preferred embodiment, hollow projection portion 54 is formed on an upper portion of stator housing 38. Hollow projection portion 54 extends upward from stator housing and has a chimney pipe shape. Connecting portion 53 is disposed inside of hollow projection portion 54. Hollow projection portion 54 is substantially sealed to the exterior of compressor by seal member 55, and the lower end of hollow projection portion 54 is open to stator housing 38, such that wire 52 may be readily connected to stator 37.

In hybrid compressor 1, described above, because connecting portion 53 for connecting external terminal 51 for supplying electricity to motor 35 and wire 52 of stator 37 of motor 35. Connecting portion 53 is positioned above motor 35 and second compression mechanism 3. If liquid refrigerant collects in second compression mechanism 3, the level of liquid refrigerant does not readily contact with connecting portion 53. Therefore, connecting portion 53 is not submerged in the liquid refrigerant, and connecting portion 53 may maintain high insulation performance.

In this preferred embodiment of the present invention, because hollow projection portion 54 is formed on the upper portion of stator housing 38 and connecting portion 53 is disposed inside of hollow projection portion 54, when the inside of stator housing 54 is filled with liquid refrigerant connection portion 53 of terminal portion 50 does not readily contact with the liquid refrigerant, and, therefore, connecting portion 53 may maintain high insulation performance. Referring to FIG. 2, a liquid level 56 of the refrigerant in stator housing 38 is below hollow projection portion 54. Further, because hollow projection portion 54 is substantially sealed to the exterior of compressor 1, when the inside of stator housing 38 is filled with the liquid refrigerant, the liquid level is prevented from rising into hollow projection portion 54 by a gaseous body (e.g., refrigerant gas) trapped inside of hollow projection portion 54.

The motor driven compressor of the present invention is not limited to hybrid-type compressors, but may be employed in a general, motor driven compressor having a single compression mechanism driven by a motor.

Although preferred embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A motor driven compressor having a motor for driving a compression mechanism comprising:

a connecting portion for connecting between an external terminal for electric supply to said motor and a wire end portion of a stator of said motor, said stator being fixed;

wherein said connecting portion is located above said motor and said compression mechanism, and is formed on a stator housing which accommodates said motor, and wherein said connecting portion is sealed to the exterior of said motor driven compressor and arranged in a hollow projection portion which extends upward from said stator housing, said motor driven compressor further having a hybrid compressor comprising:

a first compression mechanism, configured to be a scroll-type compression mechanism, and driven by a first drive source separate from said motor; and a second compression mechanism, configured to be a scroll-type compression mechanism, and driven by said motor as a second drive source, and wherein a first scroll of said first compression mechanism and a second fixed scroll of said second compression mechanism are disposed to extend in opposite directions from a common valve plate.

2. The motor driven compressor of claim 1, wherein said first fixed scroll and said second fixed scroll are integrally formed.

3. The motor driven compressor of claim 1, wherein said first drive source comprises an engine for driving a vehicle.

4. A hybrid compressor comprising:

a first compression mechanism which is driven by an engine for driving a vehicle, and a second compression mechanism, which is driven by a motor; and a connecting portion for connecting between an external terminal for supplying electricity to said motor and a wire end portion of a stator of said motor;

wherein said connecting portion is located above said motor and said first and second compression mechanism, and wherein each of said first and second compression mechanism is a scroll-type compression mechanism, wherein a first fixed scroll of said first compression mechanism and a second fixed scroll of said second compression mechanism are disposed to extend in opposite directions from a connection valve plate.

5. The motor driven compressor of claim 4, wherein said first fixed scroll and said second fixed scroll are integrally formed.

* * * * *